US012703894B2

(12) United States Patent
Villalon, Jr. et al.

(10) Patent No.: US 12,703,894 B2
(45) Date of Patent: Aug. 11, 2026

(54) CARBONATION AND SELECTIVE LEACHING FOR THE RECOVERY OF METALS

(71) Applicant: Phoenix Tailings, Inc., Woburn, MA (US)

(72) Inventors: Thomas Anthony Villalon, Jr., Boston, MA (US); Rita Marie Silbernagel, Cambridge, MA (US); Henry Chase Hutcheson, Malden, MA (US)

(73) Assignee: Phoenix Tailings, Inc., Woburn, MA (US)

( * ) Notice: Subject to any disclaimer, the term of this patent is extended or adjusted under 35 U.S.C. 154(b) by 0 days.

(21) Appl. No.: 19/110,052

(22) PCT Filed: Sep. 8, 2023

(86) PCT No.: PCT/US2023/032309

§ 371 (c)(1),
(2) Date: Mar. 7, 2025

(87) PCT Pub. No.: WO2024/054641

PCT Pub. Date: Mar. 14, 2024

(65) Prior Publication Data

US 2025/0257423 A1 Aug. 14, 2025

Related U.S. Application Data

(60) Provisional application No. 63/405,047, filed on Sep. 9, 2022.

(51) Int. Cl.

| | |
|---|---|
| ***C22B 3/14*** | (2006.01) |
| ***C22B 3/22*** | (2006.01) |
| ***C22B 15/00*** | (2006.01) |

(52) U.S. Cl.

CPC ..... *C22B 15/001* (2013.01); *C22B 3/14* (2013.01); *C22B 3/22* (2013.01); *C22B 15/0078* (2013.01); *C22B 15/0086* (2013.01)

(58) Field of Classification Search

CPC ..... C22B 15/001; C22B 3/14; C22B 3/22; C22B 15/0086; C22B 15/0078; C22B 3/04; C22B 3/12

See application file for complete search history.

(56) References Cited

U.S. PATENT DOCUMENTS

| | | | | |
|---|---|---|---|---|
| 1,943,341 A | | 1/1934 | Mitchell | |
| 2,847,300 A | * | 8/1958 | Paull | 75/3 |

(Continued)

FOREIGN PATENT DOCUMENTS

| | | | | |
|---|---|---|---|---|
| AU | 2015334553 A1 | * | 6/2017 | C22B 3/06 |
| AU | 2015334553 B2 | * | 3/2020 | C22B 3/06 |
| CN | 101423897 A | | 5/2009 | |
| CN | 110205489 A | * | 9/2019 | |
| CN | 110228816 A | * | 9/2019 | C22B 3/14 |

(Continued)

OTHER PUBLICATIONS

International Search Report and Written Opinion for International Application No. PCT/US2023/032309 dated Jan. 5, 2024.

(Continued)

*Primary Examiner* — Wayne A Langel
(74) *Attorney, Agent, or Firm* — Wolf, Greenfield & Sacks, P.C.

(57) ABSTRACT

The present disclosure is related to carbonation and selective ammonia leaching for the recovery of minor metals.

20 Claims, 1 Drawing Sheet

(56) References Cited

U.S. PATENT DOCUMENTS

| | | | |
|---|---|---|---|
| 2,928,732 | A | 3/1960 | Bare et al. |
| 3,647,423 | A | 3/1972 | Acoveno |
| 3,799,764 | A | 3/1974 | Coffin et al. |
| 3,929,598 | A | 12/1975 | Stern et al. |
| 4,020,143 | A | 4/1977 | Lueders et al. |
| 4,115,214 | A | 9/1978 | Hargis |
| 4,680,055 | A | 7/1987 | Sharma |
| 4,767,455 | A | 8/1988 | Jourdan |
| 4,865,701 | A | 9/1989 | Beck et al. |
| 5,938,914 | A | 8/1999 | Dawless et al. |
| 2007/0178031 | A1 | 8/2007 | Freeman et al. |
| 2010/0034724 | A1 | 2/2010 | Keith et al. |
| 2014/0147371 | A1 | 5/2014 | Blencoe et al. |
| 2014/0205520 | A1 | 7/2014 | Walder |
| 2017/0341942 | A1 | 11/2017 | Harper, Jr. |

FOREIGN PATENT DOCUMENTS

| | | | | |
|---|---|---|---|---|
| CN | 110819797 | A | 2/2020 | |
| CN | 111411372 | A | 7/2020 | |
| GB | 1348031 | A | 3/1974 | |
| RU | 93007396 | A | 3/1996 | |
| WO | WO-2007069902 | A1 * | 6/2007 | ..... C01F 5/24 |
| WO | WO 2011/047070 | A1 | 4/2011 | |
| WO | WO 2015/039177 | A1 | 3/2015 | |
| WO | WO 2016/063187 | A1 * | 4/2016 | ..... C22B 3/04 |
| WO | WO 2018/114925 | A1 | 6/2018 | |
| WO | WO 2022/077112 | A1 | 4/2022 | |

OTHER PUBLICATIONS

International Preliminary Report on Patentability (Chapter 2) for International Application No. PCT/US2023/032309 dated Oct. 10, 2024.

[No Author Listed], Anode Effect in Molten Fluoride Electrolysis. In: Graphite Fluorides. 1988. Watanabe et al., Eds. Chapter 1:1-22. doi: 10.1016/B978-0-444-42885-1.50006-3.

[No Author Listed], Extracting Aluminium. Shalom Education. https://www.shalom-education.com/courses/gcsechemistry/lessons/chemical-changes/topic/extracting-aluminium/ [last accessed Apr. 2, 2025]: 2 pages.

Castrillejo et al., Electrochemical behaviour of dysprosium in the eutectic LiCl—KCl at W and AI electrodes. Electrochim Acta. Mar. 15, 2005;50(10):2047-57.

Erasmus, Leaching of nickel laterite with a solution of ammonia and ammonium carbonate utilizing solids liquid separation under pressure. Thesis. Masters of Science in Engineering. Extractive Meetallurgical Engineering. Stellenbosch Univ. Mar. 2012: 198 pages.

Li et al., Integrated Mineral Carbonation of Ultramafic Mine Deposits—A Review. Minerals. Apr. 2018;8(4):147.

Matsumiya, Electrodeposition of Rare Earth Metal in Ionic Liquids. In: Application of Ionic Liquids on Rare Earth Green Separation and Utilization. Green Chemistry and Sustainable Technology. 2016. Chen et al., Eds. Chapter 6: 117-53. doi: 10.1007/978-3-662-47510-2_6.

O'Connor et al., Energy and economic evaluation of ex situ aqueous mineral carbonation. Proceedings of the 7th International Conference on Greenhouse Gas Control. 2005;2(2):2011-5. doi: 10.1016/B978-008044704-9/50261-5.

Saila et al., Electrochemical behaviour of dysprosium(III) in LiF—CaF2 on Mo, Ni and Cu electrodes. J Electroanal Chem. Apr. 15, 2010;642(2):150-6.

Santos et al., Nickel Extraction from Olivine: Effect of Carbonation Pre-Treatment. Metals. Sep. 2015;5(3):1620-44.

Wilson et al., Fizzy ore processing sequesters CO2 while supplying critical metals. Proc Natl Acad Sci U S A. Sep. 27, 2022;119(39):e2212424119. doi: 10.1073/pnas.2212424119. Epub Sep. 14, 2022.

* cited by examiner

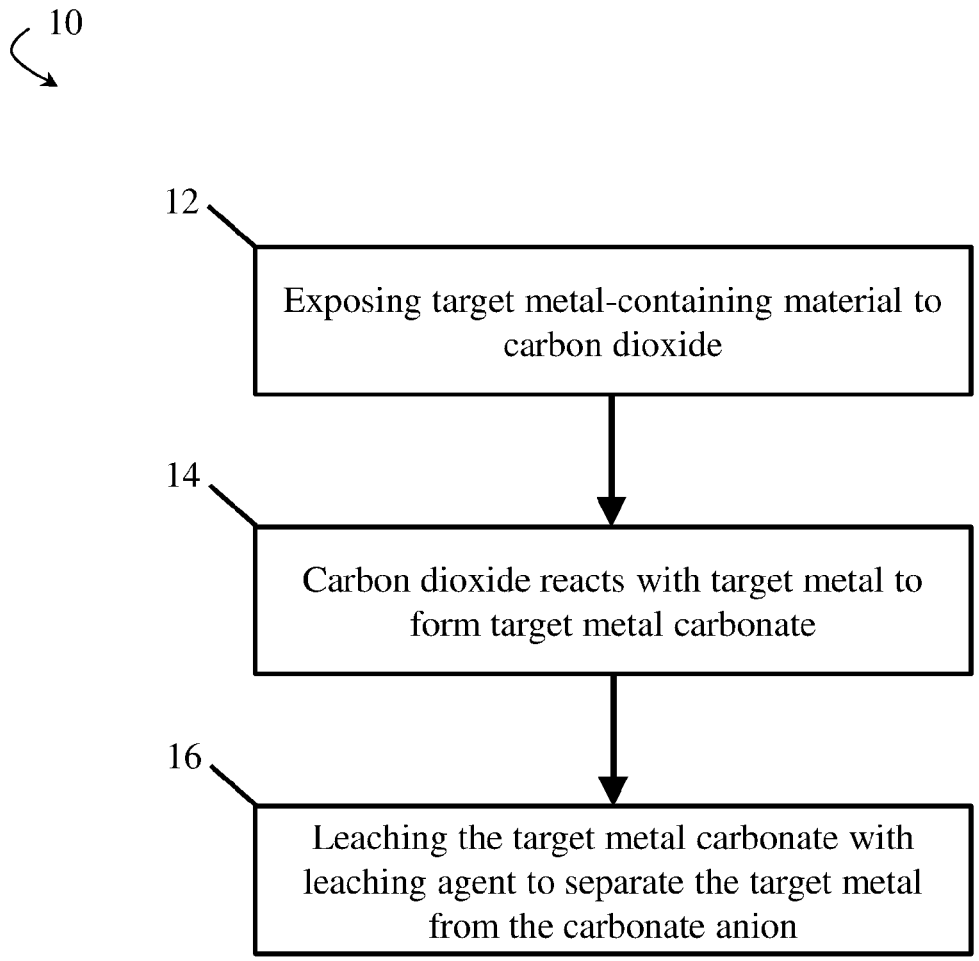
10
12
Exposing target metal-containing material to carbon dioxide
14
Carbon dioxide reacts with target metal to form target metal carbonate
16
Leaching the target metal carbonate with leaching agent to separate the target metal from the carbonate anion

CARBONATION AND SELECTIVE LEACHING FOR THE RECOVERY OF METALS

RELATED APPLICATIONS

This application is a national stage filing under 35 U.S.C. § 371 of International Application No. PCT/US2023/032309, filed Sep. 8, 2023, and entitled "Carbonation and Selective Leaching for the Recovery of Metals," which claims priority under 35 U.S.C. § 119(e) to U.S. Provisional Application No. 63/405,047, filed Sep. 9, 2022, and entitled "Carbonation and Selective Leaching for the Recovery of Metals," each of which is incorporated herein by reference in its entirety for all purposes.

TECHNICAL FIELD

Carbonation and selective leaching for the recovery of minor and/or other metals are generally described.

SUMMARY

The present disclosure is related to carbonation and selective leaching for the recovery of metals. The selective leaching can be achieved using, in some embodiments, ammonia. The metals that are recovered can be, in some embodiments, present in small quantities in the material from which they are extracted. The subject matter of the present invention involves, in some cases, interrelated products, alternative solutions to a particular problem, and/or a plurality of different uses of one or more systems and/or articles.

Certain aspects are related to methods for extracting a target metal from a target metal-containing material.

In some embodiments, the method comprises exposing the target metal-containing material to carbon dioxide such that the carbon dioxide reacts with target metal associated with the target-metal containing material to form target metal carbonate; and leaching the target metal carbonate with a leaching agent to separate the target metal from the carbonate anion, wherein the leaching results in less than 10 wt % of the carbonate material from the target metal carbonate forming carbon dioxide.

In some embodiments, the method comprises exposing the target metal-containing material to carbon dioxide such that the carbon dioxide reacts with target metal associated with the target-metal containing material to form target metal carbonate, wherein the target metal is a transition metal; and leaching the target metal carbonate with a leaching agent to separate the target metal from the carbonate anion, wherein the leaching results in less than 10 wt % of the carbonate material from the target metal carbonate forming carbon dioxide.

In some embodiments, the method comprises exposing the target metal-containing material to carbon dioxide such that the carbon dioxide reacts with target metal associated with the target-metal containing material to form target metal carbonate, wherein the target metal is a transition metal; and leaching the target metal carbonate with a leaching agent to separate the target metal from the carbonate anion.

Other advantages and novel features of the present invention will become apparent from the following detailed description of various non-limiting embodiments of the invention when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present invention will be described by way of example with reference to the accompanying figures, which are schematic and are not intended to be drawn to scale unless otherwise indicated. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures:

FIG. 1 is, in accordance with certain embodiments, a flow diagram illustrating a method for extracting a target metal from a target metal-containing material.

DETAILED DESCRIPTION

Carbonation and selective leaching for the recovery of metals are generally described. The selective leaching can be achieved using, in some embodiments, ammonia. The metals that are recovered can be, in some embodiments, present in small quantities in the material from which they are extracted.

Certain aspects of the present disclosure are directed to the discovery that the use of carbon dioxide and certain leaching agent(s) (e.g., ammonia) can allow for selective extraction and recovery of at least one target metal from materials containing the target metal and one or more other materials (e.g., non-target metal materials). Certain embodiments are related to the discovery that the processes described herein can provide, in certain instances, one or more of a variety of operational advantages including, but not limited to, selective removal of target metal (e.g., minor metal) relative to non-target-metal materials (e.g., base metal), lower operating temperature and pressure, reduced gas generation, and/or reduced waste generation. Some embodiments are related to the discovery that effective target metal extraction can be achieved with little to no carbon dioxide formation during the leaching process.

In some embodiments, a method for extracting a target metal from a target metal-containing material is provided. FIG. 1 is a flow diagram illustrating one such process that can be used to extract a target metal from a target metal-containing material. This figure is referred to throughout the disclosure below.

In some embodiments, some or all of the steps performed as part of a method for extracting a target metal from a target metal-containing material, such as some or all of the steps shown in FIG. 1, is performed in a closed system. In other words, some or all such steps may be performed in a system that is fluidically isolated from an environment external thereto, to which no materials are added during performance of such steps, and/or from which no materials are removed during performance of such steps.

It is also possible for some or all of the steps performed as part of a method for extracting a target metal from a target metal-containing material, such as some or all of the steps shown in FIG. 1, to be performed in a manner that only requires the operator to take one set of actions. For instance, in some embodiments, the target metal-containing material, the carbon dioxide (and/or reagents that react to form carbon dioxide, such as water and a metal salt), and the leaching agent are added to a reactor, the reactor is optionally closed, and then these materials are allowed to react. In such embodiments, the exposure of the target metal-containing material to the carbon dioxide may occur concurrently with the leaching thereof, may occur during periods of time that partially overlap, and/or may occur during periods of time that do not overlap.

In some embodiments, the method comprises exposing a target metal-containing material to carbon dioxide. For example, as shown in FIG. 1, step 12 of method 10 comprises exposing the target metal-containing material to carbon dioxide. As used herein, "target metal-containing material" is a material that contains one or more target metal(s). As used herein, "target metal" refers to metal that is (1) in a zero oxidation state or (ii) is in a non-zero oxidation state form within a compound other than a halogen compound. For example, metallic copper would be considered a target metal because it is a metal in a zero oxidation state. For example, the copper within copper silicate would be considered a target metal because the copper in copper silicate has a non-zero oxidation state and copper silicate is a non-halogen compound. The copper within copper chloride would not, on the other hand, be considered a target metal because the copper in copper chloride is in a halogen compound.

In some embodiments, the target metal-containing material comprises silicon. In some embodiments, the target metal-containing material is a target metal silicate (i.e., a silicate of the target metal). The silicate, according to some embodiments, may be include orthosilicate, metasilicate, and/or pyrosilicate. The target metal-containing material may include any of a variety of target metal(s) described below.

Any of a variety of target metal-containing materials may be employed. Non-limiting examples of target metal-containing materials include mafic rocks, ultramafic rocks, basalt, diabase, gabbro, olivine minerals, pyroxene minerals, and/or serpentine minerals. Specific non-limiting examples of olivine minerals include forsterite, fayalite, and/or monticellite. Specific non-limiting examples of pyroxene minerals include wollastonite, enstatite, and/or ferrosilite. Specific non-limiting examples of serpentine minerals include lizardite and/or antigorite. Additionally or alternatively, the target metal-containing material may comprise alkaline earth silicates, such as a biotite, an amphibole, and/or cuprorivaite. In some embodiments, the target metal-containing material comprises mining tailings. The target metal-containing material(s) is not limited to these examples, and the present disclosure can also be used with other mineral types comprising target metal(s).

In some embodiments, the target metal within the target metal-containing materials may be in the form of a metal cation. The metal cation can have, for example, an oxidation state of greater than +1, such as an oxidation state of +2, +3, +4, +5, +6, or +7. In some embodiments, the target metal within the target metal-containing materials is a metallic metal having a zero oxidation state. Non-limiting example of such metals include one or more target metals described above, such as silver and copper.

In some embodiments, the one or more target metal(s) comprise minor metal(s). The "minor metal(s)", as used herein, are by-product(s) produced from smelting a base metal. Non-limiting examples of minor metal(s) include antimony (Sb), arsenic (As), beryllium (Be), bismuth (Bi), cadmium (Cd), cerium (Ce), chromium (Cr), cobalt (Co), gadolinium (Gd), gallium (Ga), germanium (Ge), hafnium (Hf), indium (In), lithium (Li), magnesium (Mg), manganese (Mn), mercury (Hg), molybdenum (Mo), neodymium (Nd), niobium (Nb), iridium (Ir), osmium (Os), praseodymium (Pr), rhenium (Re), rhodium (Rh), ruthenium (Ru), samarium (Sm), selenium (Se), tantalum (Ta), tellurium (Te), titanium (Ti), tungsten (W), vanadium (V), and/or zirconium (Zr).

In some embodiments, the one or more target metal(s) comprise transition metal(s). The "transition metal(s)," as used herein, are scandium (Sc), yttrium (Y), lanthanum (La), actinium (Ac), titanium (Ti), zirconium (Zr), hafnium (Hf), rutherfordium (Rf), vanadium (V), niobium (Nb), tantalum (Ta), dubnium (Db), chromium (Cr), molybdenum (Mo), tungsten (W), seaborgium (Sg), manganese (Mn), technetium (Tc), rhenium (Re), bohrium (Bh), ruthenium (Ru), osmium (Os), hassium (Hs), cobalt (Co), rhodium (Rh), iridium (Ir), meitnerium (Mt), nickel (Ni), palladium (Pd), platinum (Pt), darmstadtium (Ds), copper (Cu), silver (Ag), gold (Au), roentgenium (Rg), zinc (Zn), cadmium (Cd), mercury (Hg), and copernicium (Cn). In some embodiments, the one or more target metal(s) comprise Cu, Ni, and/or Co. Without wishing to be bound by any particular theory, it is believed that these metals respond similarly to the processes described herein.

In some embodiments, the target metal present in the target-metal-containing material comprises one or more platinum group metals (PGMs). Examples of platinum group metals include platinum (Pt), palladium (Pd), rhodium (Rh), iridium (Ir), osmium (Os), and ruthenium (Ru). Alternatively or additionally, the target metal present in the target-metal-containing material may comprise one or more noble metals. Examples of noble metals include platinum (Pt), palladium (Pd), rhodium (Rh), iridium (Ir), osmium (Os), ruthenium (Ru), gold (Au), and silver (Ag).

It should be noted that it is possible for a target-metal-containing material to include exactly one target metal. It is also possible for a target-metal-containing material to comprise two or more target metals. In such instances, both a first and a second target metal (and, possibly third or higher target metals) may undergo the same processes described herein with respect to "the target metal." For instance, all such target metals may be exposed to carbon dioxide, may react with the carbon dioxide to form a target metal carbonate, may be leached, and/or may be separated. In some embodiments, during the formation of a target metal carbonate, a carbonate is formed that comprises two or more target metals. It is also possible for two or more different carbonates to form, each comprising a target metal. Similarly, it is possible for different target metals extracted together to be leached together (e.g., by use of a common leaching agent, into a common solution) and/or separately (e.g., with different leaching agents, into different solutions). Also similarly, it is possible for different target metals extracted together to be recovered together (e.g., as an alloy) or separately.

The target metal (e.g., minor metals) may be present in the target-metal-containing material in any of a variety of appropriate amounts. In some embodiments, the target metal may be present in the target-metal-containing material in an amount of less than or equal to 15 wt %, less than or equal to 10 wt %, less than or equal to 5 wt %, and/or down to 2 wt %, down to 1 wt %, or down to 0.1 wt %.

In certain embodiments, it can be particularly advantageous to use the method described herein to extract target metals comprising nickel, copper, cobalt, zinc, chromium, silver, gold, and/or platinum group metals.

In some embodiments, the one or more target metal(s) may include any appropriate metal(s) capable of forming a metal carbonate in the presence of carbon dioxide. Additionally or alternatively, in certain embodiments, the one or more target metal(s) may include any appropriate metal(s) capable of coordinating with a leaching agent (e.g., a compound containing an amino group and/or ammonia) via coordination chemistry to form a metal ammine complex. In some embodiments, the metal ammine complex is a carbonato-ammine complex of the metal. In some embodiments, the metal ammine complex is a water soluble complex. For example, in one set of embodiments, the target metal (M), according to some embodiments, may be capable of forming a metal ammine complex having the form of $[M(NH_3)_n]^{m+}$, wherein n is 2-6, and m is 1-3. In some embodiments, n is greater than or equal to 2, greater than or equal to 3, greater than or equal to 4, or greater than or equal to 5. In some embodiments, n is less than or equal to 6, less than or equal to 5, less than or equal to 4, or less than or equal to 3. Combinations of the above-reference ranges are possible (e.g., greater than or equal to 2 and less than or equal to 6). In some embodiments, m is greater than or equal to 1 or greater than or equal to 2. In some embodiments, m is less than or equal to 3 or less than or equal to 2. Combinations of the above-reference ranges are possible (e.g., greater than or equal to 1 and less than or equal to 3).

In certain embodiments, it can be particularly advantageous to use the methods described herein to extract target metals capable of: (i) forming a metal carbonate in the presence of carbon dioxide; and (ii) coordinating with a leaching agent (e.g., a compound containing an amino group and/or ammonia) to form a metal ammine complex as described above.

In some embodiments, the target metal-containing material may comprise one or more non-target metal(s). As used herein, "non-target metal(s)" refer to metal(s) that are (i) incapable of forming a (stable) metal carbonate in the presence of carbon dioxide; and/or (ii) incapable of reacting with a leaching agent (e.g., ammonia and/or a compound containing an amino group) to form a metal ammine complex (e.g., a water soluble metal ammine complex) or an appreciable amount of the metal ammine complex.

In some embodiments, non-target metal(s) incapable of forming stable metal carbonate(s) comprise base metal(s). Non-limiting examples of non-target base metal(s) include iron, silicon, and aluminum.

In some embodiments, non-target metal(s) may have limited reactivity with a leaching agent (e.g., a compound containing an amino group and/or ammonia) to form a metal ammine complex. In some embodiments, non-target metal(s) incapable of forming a metal ammine complex or an appreciable amount of the metal ammine complex include alkali metal, alkaline earth metals, and/or one or more base metals described above. For example, in some embodiments, for a given non-target metal, less than 50 wt %, less than 40 wt %, less than 30 wt %, less than 20 wt %, less than 10 wt %, less than 5 wt %, and/or down to 1 wt %, down to 0.5 wt %, or down to 0 wt % of the non-target metal within a metal-containing material may be capable of forming a metal ammine complex (e.g., a water soluble metal ammine complex). The term "alkali metal" is used herein to refer to the following six chemical elements of Group 1 of the periodic table: lithium (Li), sodium (Na), potassium (K), rubidium (Rb), cesium (Cs), and francium (Fr). The term "alkaline earth metal" is used herein to refer to the six chemical elements in Group 2 of the periodic table: beryllium (Be), magnesium (Mg), calcium (Ca), strontium (Sr), barium (Ba), and radium (Ra).

The target metal-containing material may be exposed to carbon dioxide via any of a variety of appropriate routes. For example, in one set of embodiments, the target metal-containing material may be exposed to gaseous carbon dioxide in the absence of a liquid medium. It is also possible for the target metal-containing material to be exposed to gaseous carbon dioxide in the presence of a liquid, such as water. Alternatively or additionally, the target metal-containing material may be exposed to water and a carbonate salt. The target metal-containing material may in turn be exposed to the carbon dioxide produced by water and the carbonate salt. Non-limiting examples of carbonate salt include sodium carbonate, sodium bicarbonate, potassium carbonate, potassium bicarbonate, and calcium carbonate.

When water is present during the exposure of a target metal-containing material to gaseous carbon dioxide, it may be present in a variety of suitable amounts. In some embodiments, the target metal-containing material and water may together form a slurry. In some embodiments, water makes up greater than or equal to 0 wt %, greater than or equal to 1 wt %, greater than or equal to 2 wt %, greater than or equal to 5 wt %, greater than or equal to 7.5 wt %, greater than or equal to 10 wt %, greater than or equal to 15 wt %, greater than or equal to 20 wt %, greater than or equal to 25 wt %, greater than or equal to 30 wt %, greater than or equal to 40 wt %, greater than or equal to 50 wt %, greater than or equal to 60 wt %, greater than or equal to 70 wt %, greater than or equal to 80 wt %, or greater than or equal to 95 wt % of a slurry comprising the target metal-containing material and water. In some embodiments, water makes up less than or equal to 98 wt %, less than or equal to 95 wt %, less than or equal to 90 wt %, less than or equal to 80 wt %, less than or equal to 70 wt %, less than or equal to 60 wt %, less than or equal to 50 wt %, less than or equal to 40 wt %, less than or equal to 30 wt %, less than or equal to 25 wt %, less than or equal to 20 wt %, less than or equal to 15 wt %, less than or equal to 10 wt %, less than or equal to 7.5 wt %, less than or equal to 5 wt %, less than or equal to 2 wt %, or less than or equal to 1 wt % of a slurry comprising the target metal-containing material and water. In some embodiments no water is present during exposure of a target metal-containing material to gaseous carbon dioxide. Combinations of the above-referenced ranges are also possible (e.g., greater than or equal to 0 wt % and less than or equal to 98 wt %). Other ranges are also possible.

In some embodiments, upon exposing the target metal-containing material to carbon dioxide, the carbon dioxide reacts with the target metal associated with the target metal-containing material to form a target metal carbonate (i.e., carbonate of the target metal). For example, one such embodiment is illustrated by step 14 of FIG. 1. In some embodiments, the method described herein may advantageously allow for selective carbonation of one or more target metal(s) relative to one or more non-target metal(s). In some embodiments, greater than or equal to 35 wt %, greater than or equal to 50 wt %, greater than or equal to 75 wt %, greater than or equal to 90 wt %, greater than or equal to 95 wt %, greater than or equal to 99 wt % (and/or up to 99.5 wt %, up to 99.9 wt %, or up to 100 wt %) of the total amount of target metal originally present within the target-metal-containing material reacts with carbon dioxide to form a target metal carbonate. In some embodiments, less than or equal to 5 wt %, less than or equal to 2 wt %, less than or equal to 1 wt % (and/or down to 0.5 wt %, down to 0.1 wt %, or down to 0 wt %) of the total amount of non-target metal(s) originally present within the target-metal-containing material reacts with carbon dioxide to form a non-target metal carbonate.

In some embodiments, the exposure of the target metal to carbon dioxide and/or reaction of the carbon dioxide and the target metal is carried out in the presence of a catalyst. Any of a variety of appropriate catalysts may be used, such as ammonium carbonate, sodium carbonate, sodium chloride, and ammonium chloride.

The exposure of the target metal to carbon dioxide and/or the reaction of carbon dioxide and the target metal may be carried out at any of a variety of suitable temperatures. In some embodiments, the exposure and/or reaction may be carried out at a temperature of greater than or equal to 20° C., greater than or equal to 25° C., greater than or equal to 30° C., greater than or equal to 35° C., greater than or equal to 40° C., greater than or equal to 50° C., greater than or equal to 60° C., greater than or equal to 70° C., greater than or equal to 80° C., greater than or equal to 90° C., greater than or equal to 100° C., greater than or equal to 150° C., greater than or equal to 200° C., greater than or equal to 250° C., or greater than or equal to 300° C. In some embodiments, the exposure and/or reaction may be carried out at temperature of less than or equal to 350° C., less than or equal to 300° C., less than or equal to 250° C., less than or equal to 200° C., less than or equal to 150° C., less than or equal to 100° C., less than or equal to 90° C., less than or equal to 80° C., less than or equal to 70° C., less than or equal to 60° C., less than or equal to 50° C., less than or equal to 40° C., less than or equal to 35° C., less than or equal to 30° C., or less than or equal to 25° C. Combinations of the above-referenced ranges are possible (e.g., greater than or equal to 20° C. and less than or equal to 350° C., greater than or equal to 20° C. and less than or equal to 250° C., greater than or equal to 20° C. and less than or equal to 200° C., greater than or equal to 25° C. and less than or equal to 250° C., greater than or equal to 25° C. and less than or equal to 350° C., or greater than or equal to 30° C. and less than or equal to 90° C.). Other ranges are also possible.

The exposure of the target metal-containing material to carbon dioxide and/or reaction of carbon dioxide and the target metal may be carried out under any of a variety of suitable pressures. In some embodiments, the exposure and/or reaction may be carried out under a pressure of greater than or equal to 1 atmosphere absolute, greater than or equal to 5 atmospheres absolute, greater than or equal to 10 atmospheres absolute, greater than or equal to 25 atmospheres absolute, greater than or equal to 50 atmospheres absolute, or greater than or equal to 100 atmospheres absolute. In some embodiments, the exposure and/or reaction may be carried out under a pressure of less than or equal to 150 atmospheres absolute, less than or equal to 100 atmospheres absolute, less than or equal to 50 atmospheres absolute, less than or equal to 25 atmospheres absolute, less than or equal to 10 atmospheres absolute, or less than or equal to 5 atmospheres absolute. Combinations of the above-reference ranges are possible (e.g., greater than or equal to 1 atmosphere absolute and less than or equal to 150 atmospheres absolute). Other ranges are also possible.

In some embodiments, the exposure of the target metal-containing material to carbon dioxide and/or reaction of carbon dioxide and the target metal may be carried out under a variety of suitable carbon dioxide pressures. In some embodiments, during the exposure and/or reaction, the carbon dioxide pressure is greater than or equal to 100 psi, greater than or equal to 200 psi, greater than or equal to 500 psi, greater than or equal to 750 psi, greater than or equal to 1000 psi, greater than or equal to 1500 psi, greater than or equal to 2000 psi, greater than or equal to 2500 psi, greater than or equal to 3000 psi, greater than or equal to 3500 psi, greater than or equal to 4000 psi, or greater than or equal to 4500 psi. In some embodiments, during the exposure and/or reaction, the carbon dioxide pressure is less than or equal to 5000 psi, less than or equal to 4500 psi, less than or equal to 4000 psi, less than or equal to 3500 psi, less than or equal to 3000 psi, less than or equal to 2500 psi, less than or equal to 2000 psi, less than or equal to 1500 psi, less than or equal to 1000 psi, less than or equal to 750 psi, less than or equal to 500 psi, or less than or equal to 200 psi. Combinations of the above-referenced ranges are also possible (e.g., greater than or equal to 100 psi and less than or equal to 5000 psi, or greater than or equal to 1000 psi and less than or equal to 5000 psi). Other ranges are also possible.

In some embodiments, the gases present during carbon dioxide exposure may consist of and/or consist essentially of carbon dioxide. In such embodiments, the total pressure during the exposure of the target metal-containing material to carbon dioxide may be in one or more of the above-referenced ranges. It is also possible for one or more further gases other than carbon dioxide to be present during carbon dioxide exposure, such as one or more inert gases. In such embodiments, the partial pressure of carbon dioxide during the exposure of the target metal-containing material to carbon dioxide may be in one or more of the above-referenced ranges.

The exposure of a target metal-containing material to carbon dioxide may be performed at a temperature and pressure at which the carbon dioxide is gaseous.

In some embodiments, a target metal-containing material may be mixed while being exposed to carbon dioxide. The mixing may be accomplished with the use of a high-viscosity mixer. Two non-limiting examples of high-viscosity mixers include mixers comprising tilted vanes and ribbon mixers. Such mixers may be configured to both push components being mixed down and lift them up, which is believed to promote advantageous crossflow.

Mixing may be performed at a variety of suitable rages. In some embodiments, a target metal-containing material is mixed at a rate of greater than or equal to 300 rpm, greater than or equal to 400 rpm, greater than or equal to 500 rpm, greater than or equal to 600 rpm, greater than or equal to 700 rpm, greater than or equal to 800 rpm, or greater than or equal to 900 rpm while being exposed to carbon dioxide. In some embodiments, a target metal-containing material is mixed at a rate of less than or equal to 1000 rpm, less than or equal to 900 rpm, less than or equal to 800 rpm, less than or equal to 700 rpm, less than or equal to 600 rpm, less than or equal to 500 rpm, or less than or equal to 400 rpm while being exposed to carbon dioxide. Combinations of the above-referenced ranges are also possible (e.g., greater than or equal to 300 rpm and less than or equal to 1000 rpm). Other ranges are also possible.

In some embodiments, mixing is performed at a rate sufficient to cause the target metal-containing material, the carbon dioxide, and/or any other components present during the mixing to undergo turbulent flow.

The target metal-containing material may be exposed to carbon dioxide at one or more temperatures and/or pressures described herein for any suitable amount of time. In certain embodiments, the target metal-containing material may be exposed to carbon dioxide for greater than or equal to 1 hour, greater than or equal to 2 hours, greater than or equal to 5 hours, greater than or equal to 10 hours, greater than or equal to 15 hours, or greater than or equal to 20 hours. In some embodiments, the target metal-containing material may be exposed to carbon dioxide for less than or equal to 24 hours, less than or equal to 20 hours, less than or equal to 15 hours, less than or equal to 10 hours, less than or equal to 5 hours, or less than or equal to 2 hours. Combinations of these ranges are also possible (e.g., greater than or equal to 1 hour and less than or equal to 24 hours). Other ranges are also possible.

In some embodiments in which the target metal-containing material comprises a target metal silicate, the target metal silicate may react with carbon dioxide to form a metal carbonate and a byproduct comprising silicon and oxygen. As a non-limiting example, according to certain embodiments, the target metal-containing material is a target metal orthosilicate having the form $M_2SiO_4$, where M is the target metal. The target metal may include any of a variety of target metals described elsewhere herein (e.g., Ni, Co, Cu). The target metal orthosilicate, in certain embodiments, may react with carbon dioxide to form a metal carbonate and a silicon oxide (as shown in reaction scheme (I)).

$$M_2SiO_4+2CO_2 \rightarrow 2MCO_3+SiO_2 \quad (I)$$

It should be understood that although reaction scheme (I) provides an example of the general reaction scheme for the carbonation of metal orthosilicate, any appropriate target metal-containing material(s) described elsewhere herein may be subjected to the carbonation process.

Any appropriate amount of carbon dioxide may be added to the target metal-containing material during carbonation. In some embodiments, a molar ratio of carbon dioxide to a reactant (e.g., target metal silicate or other target metal containing compound) in the target metal-containing material may be greater than or equal to 1:10, greater than or equal to 1:5, greater than or equal to 1:2, greater than or equal to 1:1, or greater than or equal to 3:2. In some embodiments, a molar ratio of carbon dioxide to a reactant in the target metal-containing material may be less than or equal to 2:1, less than or equal to 3:2, less than or equal to 1:1, less than or equal to 1:2, or less than or equal to 1:5. Combinations of the above-referenced ranges are possible (e.g., greater than or equal to 1:10 and less than or equal to 2:1).

In some embodiments, upon carbonating the target metal-containing material to form the target metal carbonate, the target metal carbonate may be subjected to leaching with a leaching agent. In some embodiments, the leaching agent may be capable of selectively leaching (or extracting) the target metal carbonate from the target metal-containing material by forming a complex (e.g., a water-soluble complex) with the target metal carbonate. In some embodiments, upon leaching the target metal carbonate with the leaching agent, the target metal may be separated from the carbonate anion and subsequently recovered. For example, as shown in FIG. 1, step 16 can be used to illustrate the above-referenced leaching process. In some embodiments, the method described herein may advantageously allow for selective leaching of one or more target metal(s) relative to one or more non-target metal(s).

In some embodiments, the leaching agent comprises a Lewis base. In some embodiments, the leaching agent is a compound comprising an amine group. In some embodiments, a leaching agent comprises a salt, such as an ammonium salt. Such a salt may be protonated during leaching to form ammonia (e.g., in the presence of a protic solvent, such as water, with which it is supplied and/or in which leaching is performed). Any of a variety of leaching agents may be employed, including, but not limited, to ammonia, ammonium hydroxide, methylamine, aniline, and ethylamine.

In some embodiments, leaching is performed in the presence of further materials in addition to the leaching agent. For instance, leaching may be performed in the presence of a liquid and/or a solution comprising the leaching agent (e.g., in which the leaching agent is dissolved). In some embodiments, leaching is performed in the presence of an aqueous solution comprising the leaching agent.

In some embodiments, the leaching agent may include a compound capable of reacting with the target metal carbonate to form a water-soluble complex comprising the target metal, the carbonate, and the leaching agent complex. In some embodiments, the resulting water-soluble complex is a carbonato-ammine complex of the target metal comprising a carbonate anion and an ammine complex of the target metal, as described in more detail below.

In some embodiments, the leaching agent may include a compound capable of coordinating with the target metal via coordination chemistry. For example, in some embodiments in which the leaching agent is ammonia, ammonia may complex with target metal (M) to form a metal ammine complex having the form of $[M(NH_3)_n]^{m+}$.

In one set of embodiments, the leaching agent comprises ammonia. According to some embodiments, leaching the target metal carbonate with ammonia comprises forming a carbonato-ammine complex of the target metal. The carbonato-ammine complex of the target metal, according to some embodiments, comprises a carbonate anion and an ammine complex of the target metal. In some embodiments, the carbonate-ammine complex is water-soluble. A general reaction scheme illustrating the reaction between ammonia ($NH_3$) and the target metal carbonate ($MCO_3$) is shown in reaction scheme (II):

$$MCO_3+4NH_3 \rightarrow [M(NH_3)_4]^{2+}(aq)+CO_3^{2-}(aq) \quad (II)$$

As shown in reaction scheme (II), leaching with ammonia may result in a water-soluble carbonato-ammine complex of the target metal comprising a carbonate anion ($CO_3^{2-}$) and an ammine complex ($[M(NH_3)_4]^{2+}$) of the target metal (M).

Any of a variety of target metals described elsewhere herein may be leached using the leaching agent described herein. In one set of embodiments, the leached target metals comprise one or more of Ni, Cu, and/or Co.

In some embodiments, leaching of the target metal carbonate results in a small amount, if any, of carbon dioxide. For instance, any carbonate anions present during leaching may remain carbonate anions subsequent to leaching, such as carbonate anions dissolved in the solution employed during leaching.

In some embodiments, leaching of the target metal carbonate results in less than 10 wt %, less than 8 wt %, less than 6 wt %, less than 4 wt %, less than 2 wt %, less than 1 wt % and/or down to 0.5 wt %, down to 0.1 wt %, down to 0.01 wt %, or down to 0.001 wt % of the carbonate material from the target metal carbonate forming carbon dioxide. In certain embodiments, leaching of the target metal carbonate does not result in the formation of carbon dioxide (i.e., 0 wt % of the carbonate material from the target metal carbonate forms carbon dioxide).

The leaching process may be carried out at any of a variety of suitable temperatures. In some embodiments, the leaching process may be carried out at a temperature of greater than or equal to 25° C., greater than or equal to 50° C., greater than or equal to 80° C., greater than or equal to 100° C., greater than or equal to 150° C., greater than or equal to 200° C., greater than or equal to 250° C., or greater than or equal to 300° C. In some embodiments, the leaching process may be carried out at a temperature of less than or equal to 330° C., less than or equal to 300° C., less than or equal to 250° C., less than or equal to 200° C., less than or equal to 150° C., less than or equal to 100° C., less than or equal to 80° C., or less than or equal to 50° C. Combinations of the above-referenced ranges are possible (e.g., greater than or equal to 25° C. and less than or equal to 150° C., or greater than or equal to 80° C. and less than or equal to 330° C.). Other ranges are also possible.

The leaching process may be carried out under any of a variety of suitable pressures. In some embodiments, the leaching process may be carried out under a pressure of greater than or equal to 0.1 atmospheres absolute, greater than or equal to 0.5 atmospheres absolute, greater than or equal to 1 atmosphere absolute, or greater than or equal to 1.5. In some embodiments, the leaching process may be carried out under a pressure of less than or equal to 2 atmospheres absolute, less than or equal to 1.5 atmospheres absolute, less than or equal to 1 atmosphere absolute, or less than or equal to 0.5 atmospheres absolute. Combinations of the above-reference ranges are possible (e.g., greater than or equal to 0.1 atmosphere absolute and less than or equal to 2 atmospheres absolute). Other ranges are also possible.

In some embodiments, a target metal-containing material may be mixed while undergoing leaching. The mixing may be accomplished with the use of a high-viscosity mixer, such as a high-viscosity mixer described elsewhere herein.

Mixing may be performed at a variety of suitable rages. In some embodiments, a target metal-containing material is mixed at a rate of greater than or equal to 300 rpm, greater than or equal to 400 rpm, greater than or equal to 500 rpm, greater than or equal to 600 rpm, greater than or equal to 700 rpm, greater than or equal to 800 rpm, or greater than or equal to 900 rpm while undergoing leaching. In some embodiments, a target metal-containing material is mixed at a rate of less than or equal to 1000 rpm, less than or equal to 900 rpm, less than or equal to 800 rpm, less than or equal to 700 rpm, less than or equal to 600 rpm, less than or equal to 500 rpm, or less than or equal to 400 rpm while undergoing leaching. Combinations of the above-referenced ranges are also possible (e.g., greater than or equal to 300 rpm and less than or equal to 1000 rpm). Other ranges are also possible.

The leaching process may be carried out for any suitable amount of time. In certain embodiments, the leaching process may be carried out for greater than or equal to 0.5 hours, greater than or equal to 1 hour, greater than or equal to 2 hours, greater than or equal to 4 hours, or greater than or equal to 8 hours. In some embodiments, the leaching process may be carried out for less than or equal to 12 hours, less than or equal to 8 hours, less than or equal to 4 hours, less than or equal to 2 hours, or less than or equal to 1 hour. Combinations of these ranges are also possible (e.g., greater than or equal to 0.5 hours and less than or equal to 12 hours). Other ranges are also possible.

Any appropriate amount of leaching agent(s) may be added to the target metal carbonate during the leaching process. In some embodiments, a molar ratio of the leaching agent (e.g., ammonia) to target metal within the target metal carbonate may be greater than or equal to 1:5, greater than or equal to 1:2, greater than or equal to 1:1, greater than or equal to 2:1, greater than or equal to 5:1, greater than or equal to 10:1, or greater than or equal to 15:1. In some embodiments, a molar ratio of the leaching agent (e.g., ammonia) relative to the target metal within the target metal carbonate may be less than or equal to 20:1, less than or equal to 15:1, less than or equal to 10:1, less than or equal to 5:1, less than or equal to 2:1, less than or equal to 1:1, or less than or equal to 1:2. Combinations of the above-referenced ranges are possible (e.g., greater than or equal to 1:5 and less than or equal to 20:1, or greater than or equal to 1:5 and less than or equal to 10:1).

In some embodiments, the method described herein may allow for selective leaching and extraction of target metal(s) relative to non-target metal(s). For example, in one embodiment, the method may allow for selective leaching and extraction of minor metals (e.g., Ni, Co, Cu) relative to base metals (e.g., Fe, Al). Alternatively or additionally, according to certain embodiments, the method may allow for selective leaching and extraction of minor metals (e.g., Ni, Co, Cu) relative to alkali metals and/or alkaline earth metals (e.g., Mg).

In some embodiments, the ratio of mass of target metal extracted from the target metal-containing material by the leaching agent to the mass of non-target metal extracted from the target metal-containing material by the leaching agent is at least 1.1:1, at least 1.2:1, at least 1.3:1, at least 1.4:1, at least 1.5:1, at least 1.75:1, at least 2:1, at least 5:1, at least 10:1, at least 100:1, at least 1000:1, at least 10,000:1, or higher. In some embodiments, the ratio of mass of target metal extracted from the target metal-containing material by the leaching agent to the mass of non-target metal extracted from the target metal-containing material by the leaching agent is up to 100,000:1, up to $10^7$:1, up to $10^9$:1, or higher. Combinations of the above-referenced ranges are possible (e.g., at least 5:1 and up to $10^9$:1). Other ranges are also possible.

In some embodiments, subsequent to leaching, a target metal may be recovered (e.g., as a non-carbonate salt, as elemental metal, as an alloy). This may be accomplished in a variety of suitable manners, such as via filtration.

In some embodiments, subsequent to leaching, a carbonate of the target metal, is precipitated from a solution employed during leaching. One example such a carbonate is as a basic metal carbonate comprising cations of the target metal, such as a carbonate having the formula $M_2(OH)_2CO_3$ for which M is the target metal. After formation thereof, a carbonate of a target metal may be calcined to recover the target metal in elemental and/or alloyed form. In some embodiments, the calcination may be performed in a manner such that some or all of the material released may be trapped for later usage. For instance, calcination may release water vapor and/or carbon dioxide, and some or all of the water vapor and/or carbon dioxide may be trapped for this purpose.

The following examples are intended to illustrate certain embodiments of the present invention, but do not exemplify the full scope of the invention.

Example 1

This example describes carbonating and leaching copper (target metal) from cuprorivaite.

To carbonate the cuprorivaite, 10 grams of cuprorivaite was loaded into a pressure vessel with 100 grams of dry ice (i.e., solid carbon dioxide). The system was allowed to equilibrate to room temperature and a high pressure. After reaching equilibrium, the system was heated to 50° C. while a mixer was used to agitate the mixture at 300 RPM. The system was heated and mixed for 2 hours. After cooling the system and releasing excess pressure, the carbonated cuprorivaite was leached with ammonia. To leach copper from the cuprorivaite, the carbonated cuprorivaite was exposed to 50 mL of 25% ammonia solution at a temperature of 50° C. for 2 hours. After leaching, the solids and liquid were separated via filtration. After drying the filtrate, a high recovery of basic copper carbonate was obtained.

Example 2

This example describes carbonating and leaching copper (target metal) from cuprorivaite.

To carbonate the cuprorivaite, 40 grams of cuprorivaite was loaded into a pressure vessel with an excess of dry ice. The pressure vessel was bled off to a pressure of approximately 300 psi at room temperature. Then, the system was heated to 250° C. The system was heated and mixed at 300 rpm for 4 hours, then cooled, depressurized, and opened. Subsequently, the carbonated cuprorivaite was leached with ammonia. To leach copper from the cuprorivaite, the carbonated cuprorivaite was exposed to 100 mL of 30% ammonium hydroxide solution at a temperature of 50° C. and mixed for 1 hour. After leaching, the solids and liquid were separated via filtration. After drying the filtrate, a high recovery of basic copper carbonate was obtained.

Comparative Example 1

This comparative example describes the inability to leach copper (target metal) from cuprorivaite in the absence of carbonation.

The leaching process of Example 2 was performed on cuproprivaite that was not also subject to the carbonation process described therein. No copper leaching was observed.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present invention.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

Some embodiments may be embodied as a method, of which various examples have been described. The acts performed as part of the methods may be ordered in any suitable way. Accordingly, embodiments may be constructed in which acts are performed in an order different than illustrated, which may include different (e.g., more or less) acts than those that are described, and/or that may involve performing some acts simultaneously, even though the acts are shown as being performed sequentially in the embodiments specifically described above.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

In the claims, as well as in the specification above, all transitional phrases such as "comprising," "including," "carrying," "having," "containing," "involving," "holding," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03

The invention claimed is:

1. A method for extracting a target metal from a target metal-containing material, comprising:

exposing the target metal-containing material to carbon dioxide such that the carbon dioxide reacts with target metal associated with the target metal-containing material to form a target metal carbonate, wherein the target metal is a transition metal; and leaching the target metal carbonate with a leaching agent to separate the target metal from the carbonate anion.

2. The method of claim 1, wherein the leaching agent comprises a Lewis base.

3. The method of claim 1, wherein leaching the target metal carbonate comprises forming a carbonato-ammine complex of the target metal.

4. The method of claim 1, wherein the target metal is a metal capable of coordinating with ammonia to form a metal ammine complex.

5. The method of claim 1, wherein the target metal comprises cobalt, nickel, copper, zinc, chromium, silver, gold, and/or platinum group metals.

6. The method of claim 1, wherein the target metal has an oxidation state of greater than or equal to +1.

7. The method of claim 1, wherein the target metal is a metallic metal having a zero oxidation state.

8. The method of claim 1, wherein the target metal-containing material comprises mafic rocks, ultramafic rocks, olivine minerals, pyroxene minerals, and/or serpentine minerals.

9. The method of claim 1, wherein the leaching agent is ammonia.

10. The method of claim 1, wherein the exposing step is performed at a temperature of greater than or equal to 20° C. and less than or equal to 350° C.

11. The method of claim 1, wherein the leaching step is performed at a temperature of greater than or equal to 80° C. and less than or equal to 330° C.

12. The method of claim 1, wherein the method is performed in a closed system.

13. The method of claim 1, wherein, during the exposing step, a pressure of carbon dioxide is greater than or equal to 100 psi and less than or equal to 5000 psi.

14. The method of claim 1, wherein, during the exposing step, the carbon dioxide is gaseous.

15. The method of claim 1, wherein the target metal is nickel, copper, cobalt, molybdenum, and/or zinc.

16. The method of claim 1, wherein the target metal-containing material further contains a second target metal, and wherein, during the exposing step, the second target metal also forms a carbonate.

17. The method of claim 1, wherein the leaching is performed in the presence of a liquid and/or solution comprising the leaching agent.

18. The method of claim 1, wherein the leaching is carried out under a pressure of greater than or equal to 0.1 atmospheres absolute and less than or equal to 2 atmospheres absolute.

19. A method for extracting a target metal from a target metal-containing material, comprising:

exposing the target metal-containing material to carbon dioxide such that the carbon dioxide reacts with target metal associated with the target metal-containing material to form a target metal carbonate, wherein the target metal is a transition metal; and leaching the target metal carbonate with a leaching agent to separate the target metal from the carbonate anion, wherein the leaching results in less than 10 wt % of the carbonate material from the target metal carbonate forming carbon dioxide.

20. A method for extracting a target metal from a target metal-containing material, comprising:

exposing the target metal-containing material to carbon dioxide such that the carbon dioxide reacts with target metal associated with target metal-containing material to form target metal carbonate; and leaching the target metal carbonate with a leaching agent to separate the target metal from the carbonate anion, wherein the leaching results in less than 10 wt % of the carbonate material from the target metal carbonate forming carbon dioxide.

* * * * *